United States Patent [19]

Von Moltke

[11] Patent Number: 4,758,200

[45] Date of Patent: Jul. 19, 1988

[54] DOLL ASSEMBLY AND METHOD THEREFOR

[76] Inventor: Renate Von Moltke, 80 Wethersfield Ave., Hartford, Conn. 06114

[21] Appl. No.: 64,382

[22] Filed: Jun. 22, 1987

[51] Int. Cl.[4] ..... A63H 3/02; A63H 3/36

[52] U.S. Cl. ..... 446/371; 446/391

[58] Field of Search ..... 446/371, 370, 369, 373, 446/375, 391, 268, 372, 384

[56] References Cited

U.S. PATENT DOCUMENTS

| | | | |
|---|---|---|---|
| 1,065,776 | 6/1913 | Brown | 446/391 X |
| 1,428,677 | 9/1922 | Barry | 446/371 |
| 1,544,084 | 6/1925 | Wiener | 446/391 |
| 2,879,626 | 3/1959 | Gradwohl | 446/371 |

FOREIGN PATENT DOCUMENTS

| | | | |
|---|---|---|---|
| 2302079 | 7/1974 | Fed. Rep. of Germany | 446/371 |

*Primary Examiner*—Mickey Yu

*Attorney, Agent, or Firm*—Chilton, Alix & Van Kirk

[57] ABSTRACT

A doll assembly and method therefor having structures for attaching a head to a torso. The head includes an opening traversing through the neck and an enlarged cavity. A flexible sleeve stands from the torso into the neck opening and the enlarged head cavity. A ball is captured in the sleeve. The sleeve connects between the ball and shoulders of the torso to secure the head to the torso.

16 Claims, 3 Drawing Sheets

DOLL ASSEMBLY AND METHOD THEREFOR

BACKGROUND OF THE INVENTION

This invention relates generally to hand-crafted dolls and assembly methods therefor. More particularly, the present invention relates to a new and improved technique for mounting the head of a doll to the torso or main body portion of the doll.

The continued popularity of hand-crafted items has included a heightened interest in hand-crafted dolls. Of particular interest are the head and the facial features of hand-crafted dolls which are created by a number of techniques. When the head is carved from wood or is formed from a rigid material, attachment of the head to the conventional flexible or semi-flexible main body portion can become problematical both with respect to providing a connection of high integrity and a connection having pleasing and quasi-life-like aesthetic characteristics. Conventional techniques for fastening a wooden head to the torso include gluing, the use of metallic mechanical fasteners and other techniques. Such conventional techniques in many instances do not provide a secure attachment between the head and the torso, do not properly support the head in an upright orientation on the body, are relatively difficult to accomplish and/or detract from the aesthetic appearances of the dolls.

SUMMARY OF THE INVENTION

Briefly stated, the invention in a preferred form is a new and improved doll assembly and assembly method therefor which provides a new and improved technique for mounting the head of a doll such as a carved wooden head to the main body or torso of the doll.

The doll assembly comprises a torso member which forms a torso-like body having an upper portion with a pair of transversely extending shoulders. An elongated flexible receptacle, preferably in the form of sleeve, extends from the upper portion of the torso member. A head member is mounted to the torso member. The head member has a neck with a pair of spaced engagement end sections at the lower end of the neck. The engagement end sections are complementary with and engageable against the shoulders of the torso member. The head member defines an enlarged cavity and has a neck opening which extends from the cavity through the lower end of the neck. The sleeve extends through the neck opening into the cavity. A securing member is positioned in the enlarged cavity, inserted into the sleeve and captured therein. The securing object and the sleeve cooperate with the shoulders of the torso to form a clamp-like configuration for firmly securing the head member to the torso member.

In a preferred embodiment, the head member is carved from wood and the sleeve is formed of cloth-like material with the securing object being captured in the sleeve by constricting a portion of the sleeve. The securement means is preferably a wooden ball which has a diameter greater than the maximum diameter of the neck opening. The ball is enclosed in the head member. Interior portions of the head member form a tapered surface which is adjacent the neck opening and partially defines the enlarged cavity. The tapered surface is dimensioned to engageably receive the captured securement means in nest-like fashion. The shoulders of the torso member have contour surfaces which are complementary with opposed concave-shaped engagement end sections of the neck. The neck further has an extension at the lower end thereof which interacts with the torso member to resist torsional rotation of the head member relative to the torso member.

A method in accordance with the present invention for mounting a wooden doll head to a torso comprises extending the torso covering at an upper portion of the torso to form an elongated flexible sleeve. A longitudinally extending opening is formed through the neck of the wooden doll head. A portion of the head is severed to form a removeable skull cap. An enlarged cavity which communicates with the neck opening is formed in the head. The sleeve is pulled through the neck opening into the cavity. An object is inserted into the sleeve and secured in position within the sleeve so that the sleeve connects between the object and the torso in a clamp-like relationship to firmly secure the head to the torso. The skull cap is remounted to the head. The sleeve may be constricted so as to capture the object in the sleeve.

An object of the invention is to provide a new and improved doll which incorporates an improved attachment assembly for mounting the head to the torso or main body of the doll.

Another object of the invention is to provide a new and improved assembly and method for mounting a carved wooden doll head to a flexible or semi-flexible doll torso.

A further object of the invention is to provide a new and improved means for mounting a doll head to a doll torso which means may be accomplished in an efficient manner to attach the head to the torso in a secure engagement that is highly resistant to torsional rotational forces and pulling forces applied to the head and the torso.

A yet further object of the invention is to provide a new and improved means for mounting a doll head to the main doll body so as to provide a connection of high integrity between the head and the body and to present a pleasing quasi-life-like aesthetic appearance.

Other objects and advantages of the invention will become apparent from the specification and the drawings.

DETAILED DESCRIPTION OF THE INVENTION

With reference to the drawings wherein like numerals represent like parts throughout the several Figures, a doll assembly in accordance with the present invention is generally designated by the numeral 10. The doll assembly comprises a head 12 and a torso 14 which, when assembled in accordance with the present invention, provide the principal components of a completed hand-crafted doll. It should be appreciated that non-illustrated portions of the completed doll such as the arms, hands, legs and feet may be of conventional form and are not illustrated.

Figure 1:
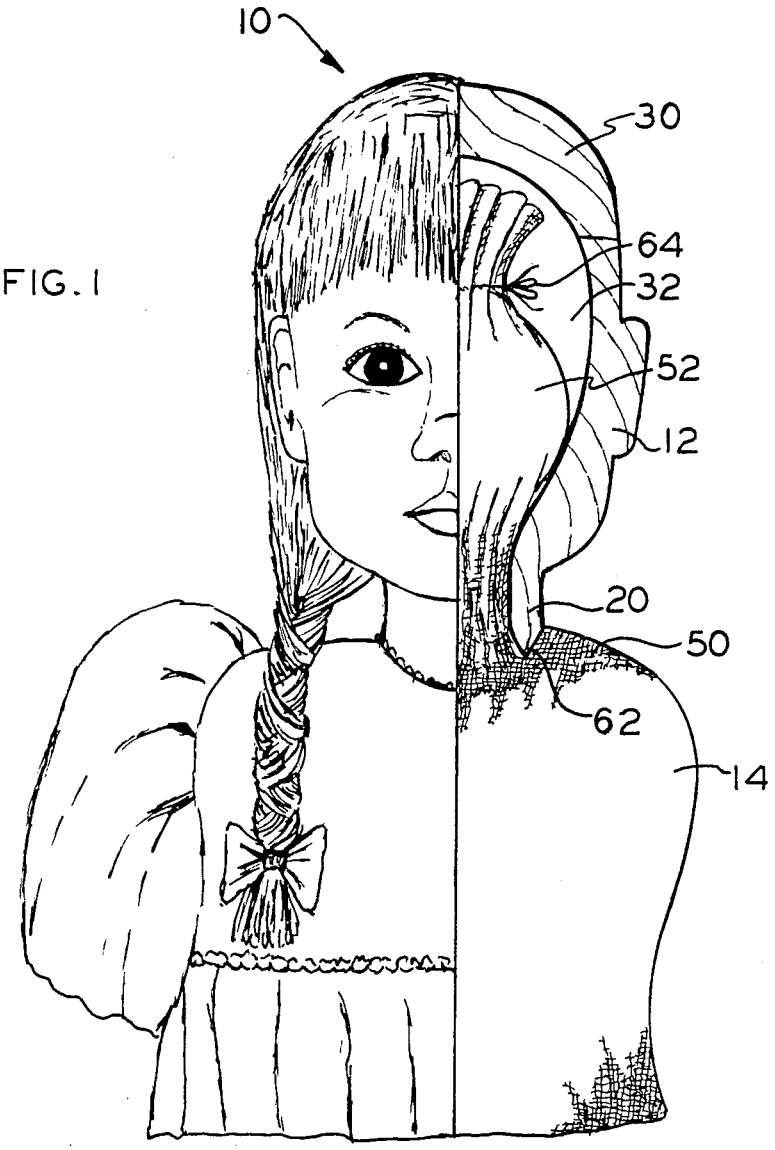
FIG. 1 is a front view of a doll assembly, partly broken away and partly in section, illustrating the assembly of the present invention.
Figure 2:
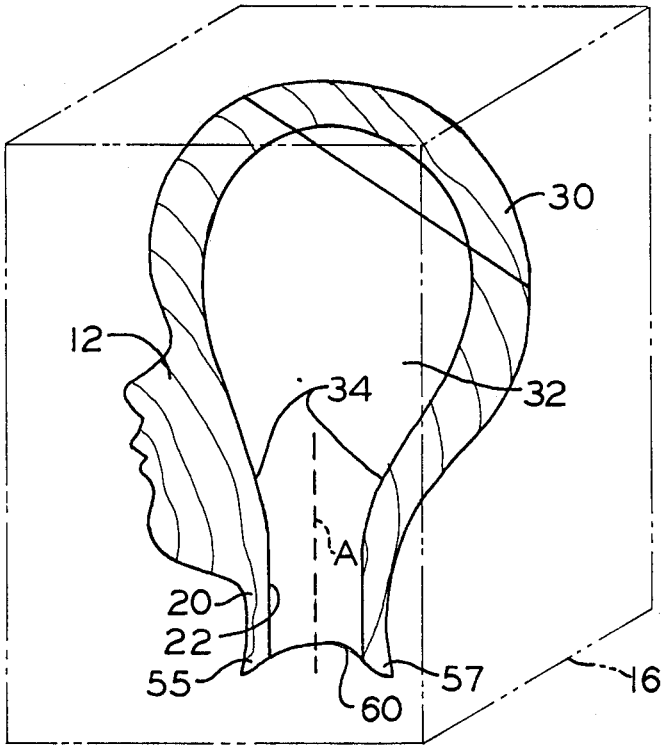
FIG. 2 is a side sectional view of the head portion of the doll assembly of FIG. 1, a wood block from which the head portion was formed being illustrated in phantom.

In preferred form, the head 12 is carved from wood and may be hand-crafted to form the facial features such as the eyes, nose and mouth. The illustrated facial features and clothes are included for descriptive purposes and are not a limitation of the invention herein. A neck 20 integrally extends from a lower portion of the head. A bore 22 is drilled through the neck at an early stage in the formation of the head. For embodiments wherein the head is hand-carved from a wood block 16 (FIG. 2), the bore 22 is formed on a drill press prior to the creation of the specific shape of the head.

Figure 4:
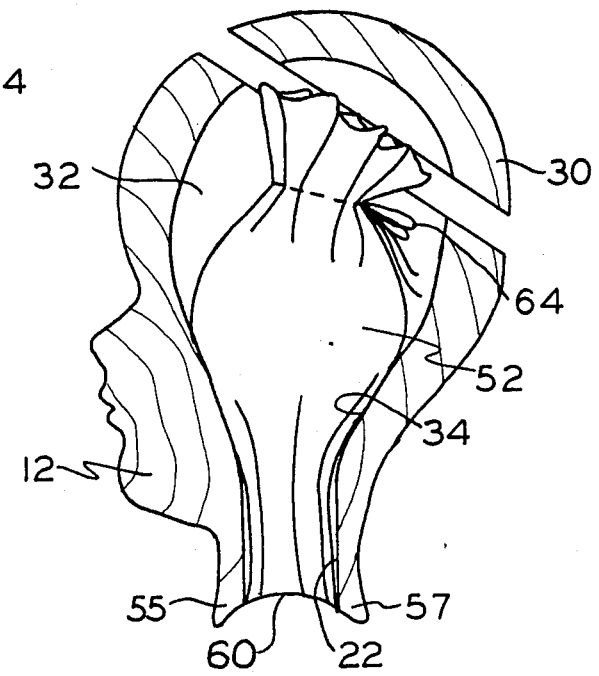
FIG. 4 is a fragmentary side sectional view of the doll assembly of FIG. 1 illustrating yet another step in the assembly method thereof.
Figure 5:
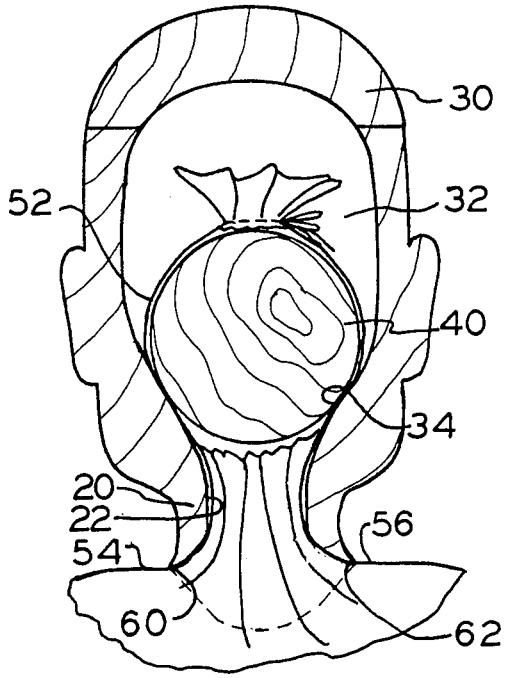
FIG. 5 is a fragmentary front sectional view of the doll assembly of FIG. 1 illustrating the method and assembly of the present invention.

After the neck opening 22 is formed in the block of wood, the gross outline of the head may be obtained by cutting the block of wood on a band saw or other suitable cutting equipment. The head is further shaped with a power woodworking tool and then hand carved. After the head features have been carved, the head is sanded and stained. The head 12 is then cut in transverse section as best illustrated in FIG. 4 so that a skull cap 30 is severed from the main portion of the head.

The main portion of the head is then hollowed out to form an enlarged cavity 32. The cavity 32 may be formed by conventional wood carving techniques. The enlarged cavity 32 is formed so as to communicate with the drilled neck opening 22. The enlarged cavity 32 and the neck opening 22 form a generally bulb-shaped space at the head interior. The diameter of the neck opening, which is substantially uniform by virtue of its formation on the drill press, has a maximum diameter that is less than the maximum diameter of the enlarged cavity 32.

The interior head portions defining the cavity 32 adjacent the neck opening 22 are preferably shaped to form a quasi-conical tapered surface 34 which converges toward the direction of the central axis A of the neck opening. The enlarged cavity 32 is dimensioned and shaped so as to receive a wooden ball 40 which typically has a diameter on the order of $\frac{3}{4}$ inch to 1 inch. It will be appreciated that the diameter of the wooden ball 40 ordinarily is a function of the size of the head and is greater than the diameter of the neck opening. The interior portions of the skull cap 30 may also be carved or removed so as to define an enlarged upper region of the cavity 32.

The torso 14 is exteriorly defined by a flexible, cloth-like covering 50 which is shaped so as to form the outlines of a life-like torso. The covering 50 is filled with various materials such as fabric, cotton, synthetic filler material or the like to form the torso shape. A sleeve 5 of material integrally extends from the covering 50 at the upper portion of the torso at the base of the neck central connecting location for implementing the mounting assembly. The sleeve 52 is preferably enlarged at the outer (upper) end portion thereof. The torso portion surrounding the sleeve 52 forms a neck connector base 58. The upper portion of the torso includes a pair of shoulders 54 and 56 which are adjacent to the neck connector base 58 of the torso and extend generally transversely therefrom. The head is shaped so as to form a pair of recessed concave-shaped contoured end sections 60 and 62 at opposing lower base side portions of the neck 20. The contoured end sections 60 and 62 ar complementary with the opposing shoulders 54 and 56 of the torso.

Figure 3:
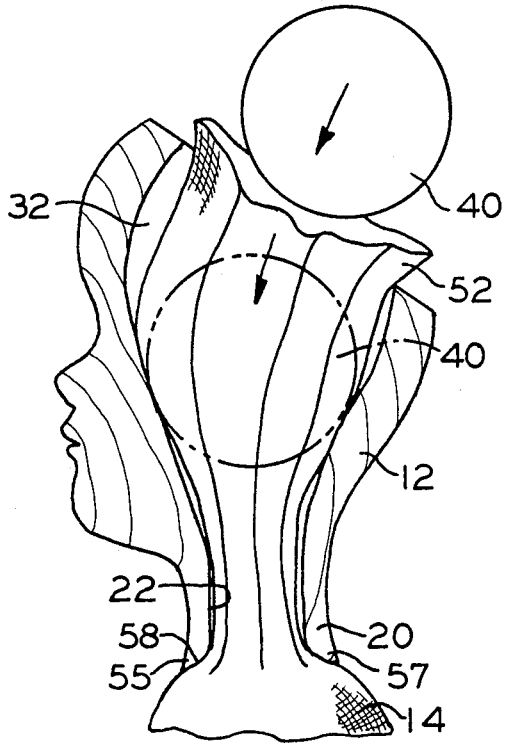
FIG. 3 is a fragmentary side sectional view, partly in schematic, of the doll assembly of FIG. 1 further illustrating the assembly method thereof.

The sleeve 52 is longitudinally dimensioned so as to extend upwardly through the neck opening 22 into the enlarged cavity 32. The sleeve is interiorly dimensioned so as to receive the wooden ball 40. The sleeve is first inserted in the neck opening and pulled upwardly into the cavity 32. The ball 40 is inserted into the sleeve. The sleeve is pulled upwardly so that the intermediate sleeve portion traversing the neck opening 22 is taut or semi-taut. The ball is simultaneously inwardly forced in the sleeve (in the direction of the FIG. 3 arrows) until the ball/sleeve assembly engages the tapered head surface 34. The outer sleeve end portion is constricted tightly around the ball so as to securely capture the ball 40 and permanently force the ball against the lower tapered bearing surface 34 of the enlarged cavity. A tie thread 64 may be suitably threaded in the sleeve and drawn taut to capture the ball. It will be appreciated that constricting the sleeve end against the ball also forces the ball toward the surface 34. The ball/sleeve assembly is retained by the tapered surface in a nest-like fashion.

Prior to constricting or stitching the sleeve end, the sleeve is pulled upwardly so that the torso 14 firmly engages against the lower base of the neck with the complementary end sections 60 and 62 aligning with and engaging the complementary shoulders 54 and 56 of the torso. The front and back lower portions of the neck 20 extend downwardly beyond the contour end sections 60 and 62 to form opposing extensions 55 and 57 which interact with the shoulder portions of the torso to prevent torsional rotation of the neck relative to the torso. The captured ball cooperates with the surface 34 and connects via the sleeve with the shoulders 54 and 56 of the torso to constrain the longitudinal movement of the head relative to the torso in a clamp-like configuration to thereby provide a rugged and durable fastening engagement between the head and the torso. In addition, the head is supported in a proper upright orientation on the body and the head engages the torso in a smooth life-like and aesthetically pleasing manner.

After the ball is stitched in place within the sleeve, the skull cap 30 is reglued in position on the main head portion. The hair and remaining features of the head are then completed. The head is then painted, waxed and wood burned as may be desired.

It will be appreciated that although a wooden ball 40 is preferred, other securing objects of various shapes may be captured in the sleeve as previously described. The sleeve functions as a receptacle for the securing object and a connecting structure which provides the clamp-like head/torso connection. A flexible segmented web-like member may be employed for capturing the securing object rather than the specific sleeve embodiment described herein. It is preferred that the interior bearing surfaces of the enlarged cavity and the contacting surfaces of the securing object captured by the sleeve be rounded or contoured to enhance the retention engagement therewith. It will be appreciated that the foregoing described doll assembly provides a relatively sturdy mounting engagement between the wooden head and the torso and is highly resistant to forces which would tend to pull and/or twist the head from the torso.

While a preferred embodiment of the foregoing invention has been set forth for purposes of description, the foregoing description should not be deemed a limitation of the invention herein. Accordingly, various modifications, adaptations and alternatives may occur to one skilled in the art without departing from the spirit and the scope of the present invention.

What is claimed is:

1. A doll assembly comprising:

torso means for forming a torso-like body comprising an upper portion with a pair of transversely extending shoulders and an elongated flexible sleeve extending from said upper portion;

head means mounted to said torso means for forming a head-like member comprising a neck extending at a lower portion thereof, said neck having a lower end forming a pair of engagement edge sections engageable against said shoulders, said head means defining an enlarged cavity and a neck opening extending from said cavity through said lower end, said sleeve extending through said opening into said cavity; and securement means positioned in said enlarges cavity, said securement means being received in said sleeve and captured thereby to limit displacement of said securement means from said shoulder means so that said securement means and sleeve cooperate with the shoulders of said torso means in a clamp-like relationship to firmly secure said head means to said torso means.

2. The doll assembly of claim 1 wherein the head means is formed of wood.

3. The doll assembly of claim 1 wherein the sleeve is formed from a cloth-like material and the securement means is captured in said sleeve by a constricted portion of said sleeve.

4. The doll assembly of claim 1 wherein the neck opening has a maximum diameter and the securement means is an object having a diameter greater than said opening maximum diameter.

5. The doll assembly of claim 1 wherein said securement means is enclosed in said head means.

6. The doll assembly of claim 1 wherein said neck engagement edge sections are recessed concave-shaped portions of said neck and said shoulders define contoured surfaces which are complementary with said neck engagement edge sections.

7. The doll assembly of claim 1 wherein said head means comprises interior portions which define a tapered surface adjacent said neck opening and partially defining said enlarged cavity, said tapered surface being dimensioned to engageably receive said captured securement means in nest-like fashion.

8. The doll assembly of claim 1 wherein said neck further comprises an extension at the lower end thereof which interacts with said torso means to resist rotation of said head means relative to said torso means.

9. A doll assembly comprising:

a torso comprising an upper portion with a pair of transversely extending shoulders and a cloth-like covering including an integral elongate flexible sleeve from a central location of said upper portion;

a head mounted to said torso comprising a neck extending at a lower portion thereof and having a pair of engagement end sections which engage against said shoulders, said head defining an enlarged cavity and an opening having a reduced diameter extending from said cavity through said lower end, said sleeve extending through said opening into said cavity; and an object having a diameter greater than said reduced diameter received in said sleeve and captured thereby so that said object is forced toward interior lower portions of the head defining said cavity wherein said sleeve connected between said object and said torso shoulders to firmly secu the head to the torso.

10. The doll assembly of claim 9 wherein the object is wooden.

11. The doll assembly of claim 9 wherein the object is captured by a threaded constriction of said sleeve.

12. The doll assembly of claim 9 wherein said head is wooden and comprises a separate skull cap which encloses said object and a portion of said sleeve in said enlarged cavity.

13. The doll assembly of claim 9 wherein said lower end of said neck has a pair of opposing recessed portions which partially define the engagement end sections and the lower end portion of said neck cooperates with the upper portion of the torso to resist relative rotation about a longitudinal axis through said neck.

14. A method for fastening a wooden doll head having a neck to a torso having a flexible covering comprising:

extending the torso covering to form an elongated flexible sleeve at an upper portion of the torso;

forming a longitudinally extending opening through said neck;

severing a portion of said head to form a removable skull cap;

forming an enlarged cavity in said head in communication with said neck opening;

pulling said sleeve through said neck opening into said cavity; and inserting an object in said sleeve and securing said object in position in said sleeve so that said sleeve connects between said object and said torso in a clamp-like relationship to firmly secure the head to the torso.

15. The method of claim 14 further comprising remounting said skull cap to said head.

16. The method of claim 14 comprising constricting said sleeve so as to securably fix said object in position.

* * * * *